US011282417B2

(12) United States Patent
Amar

(10) Patent No.: US 11,282,417 B2
(45) Date of Patent: Mar. 22, 2022

(54) DISPLAY DEVICE AND SYSTEM FOR SPORT FANS

(71) Applicant: Shahar Amar, Mabu'im (IL)

(72) Inventor: Shahar Amar, Mabu'im (IL)

(73) Assignee: BALL ON TOP LTD., Ma'Boim (IL)

( * ) Notice: Subject to any disclaimer, the term of this patent is extended or adjusted under 35 U.S.C. 154(b) by 0 days.

(21) Appl. No.: 16/623,623

(22) PCT Filed: Jul. 25, 2019

(86) PCT No.: PCT/IL2019/050845
§ 371 (c)(1),
(2) Date: Dec. 17, 2019

(87) PCT Pub. No.: WO2020/021552
PCT Pub. Date: Jan. 30, 2020

(65) Prior Publication Data

US 2021/0343200 A1 Nov. 4, 2021

(30) Foreign Application Priority Data

Jul. 26, 2018 (IL) ..... 260786

(51) Int. Cl.
*G09F 21/02* (2006.01)
*A42B 1/248* (2021.01)

(52) U.S. Cl.
CPC ..... *G09F 21/023* (2020.05); *A42B 1/248* (2013.01)

(58) Field of Classification Search
CPC ..... G09F 21/023; A42B 1/248
See application file for complete search history.

(56) References Cited

U.S. PATENT DOCUMENTS 4,729,747 A 3/1988 Yeh
5,088,127 A 2/1992 Thornock
2018/0289094 A1* 10/2018 Klipa ..... A42B 1/004

FOREIGN PATENT DOCUMENTS

KR 101408435 B1 6/2014

OTHER PUBLICATIONS

International Search Report and Written Opinion in related international application No. PCT/IL2019/050845, dated Oct. 29, 2019.

* cited by examiner

*Primary Examiner* — Thomas M Sember
(74) *Attorney, Agent, or Firm* — Law Offices of Steven W. Weinrieb

(57) ABSTRACT

An electrical battery operated display device for sport fans which is adapted to be coupled to a hat worn by a user comprises a spherical body which is displayable with visible images related to a specific sport team; one or more interface elements associated with the spherical body which are releasably securable to a display device mount; and at least first and second active elements, which, when activated, cause at least a portion of the spherical body to be controllably rotated about its central axis through interaction of the one or more releasably securable elements and simultaneously illuminated.

12 Claims, 10 Drawing Sheets

DISPLAY DEVICE AND SYSTEM FOR SPORT FANS

FIELD OF THE INVENTION

The present invention relates to the field of novelty devices. More particularly, the invention relates to a display device worn, or otherwise carried, by sport fans to encourage cheering for a specific team.

BACKGROUND OF THE INVENTION

Sport fans attending a live sporting event feel that they provide a service to the team for which they root. There is a perception that players who receive clamorous support from their fans will perform better. A side benefit for cheering for a team is the feeling of togetherness that is provided among fans of the same team when cheering and rooting together; this togetherness often remains after the fans leave the stadium.

It is an object of the present invention to provide a display device for sport fans that encourages cheering for a specific team at a given time.

It is another object of the present invention to provide a display device that is readily visible to a large number of sport fans at any given time.

It is another object of the present invention to provide a system comprising a plurality of user-associated display devices that promotes involvement of a large number of sport fans in cheering for a specific team.

Other objects and advantages of the invention will become apparent as the description proceeds.

SUMMARY OF THE INVENTION

An electrical battery operated display device for sport fans which is adapted to be coupled to a hat worn by a user comprises a spherical body which is displayable with visible images related to a specific sport team; one or more interface elements associated with the spherical body which are releasably securable to a display device mount; and at least first and second active elements, which, when activated, cause at least a portion of the spherical body to be controllably rotated about its central axis through interaction of the one or more releasably securable elements and simultaneously illuminated.

In one aspect, the first active element is a motor and the second active element is at least one illumination element, the motor and the at least one illumination element being powered by a battery and being activated by a switch, wherein the battery, the motor and the at least one illumination element are mounted interiorly to the spherical body.

In one aspect, the display further comprises a protective tubular covering of a rotor case of the motor which constitutes the display device mount, and a stationary stator-connected base relative to which the spherical body, rotor case and protective covering rotate in unison.

In one aspect, the base is magnetically coupleable to the hat by means of a magnetic plate placed in contact with an inner region of the hat to facilitate symmetric positioning of the spherical body with respect to the user's head when the hat is worn.

In one aspect, the spherical body comprises a bottom base section coupled to the hat, and an upper active section that comprises the at least first and second active elements and that is rotatable with respect to the base section about the central axis of the spherical body.

In one aspect, the motor is mounted to the upper section and the battery and the switch are housed within the upper section.

In one aspect, the display device further comprises a plurality of obliquely extending rods that support the base section from below, for increasing a height of the spherical body relative to the hat and to thereby increase visibility of the display device.

In one aspect, the display device further comprises a receiver adapted to receive a wireless signal and a controller adapted to operate device-mounted circuitry in accordance with data associated with the received signal.

In one aspect, the display device further comprises a location indicating element for indicating an instantaneous location of the display device to facilitate directing transmission of the wireless signal.

In one aspect, a first spherical body provided with a first set of visible images is able to be replaced with a second spherical body provided with a second set of visible images.

In one aspect, the visible images related to a specific sport team are selected from the group consisting of a logo of the sport team, an insignia of the sport team, a portion of the logo or of the insignia, indicia associated with the team, a picture associated with the team, one or more colors associated with the team, imprinting associated with the team, an image associated with a player or with a mascot of the team, and a combination thereof.

A system for displaying spectator-wide content at a stadium comprises a plurality of distributed hat-mounted display devices, each of the display devices configured with at least one illumination element, a receiver adapted to receive a wireless signal, a controller adapted to operate device-mounted circuitry for selectively activating the at least one illumination element in accordance with data associated with the received signal, and a battery for powering the at least one illumination element, receiver and controller; and a central transmitting unit for transmitting the wireless signal, to each of the display devices that have been registered, which includes device-specific data related to a corresponding portion of spectator-wide content that is to be displayed.

DETAILED DESCRIPTION OF THE INVENTION

The display device is worn by sport fans, and comprises one or more highly visible active elements which, when activated to be displaced or illuminated at a selected time, encourages cheering for a specific team playing for example basketball, football, baseball, hockey or soccer. The display device is adapted to be economically manufactured with inexpensive components.

Figure 1:
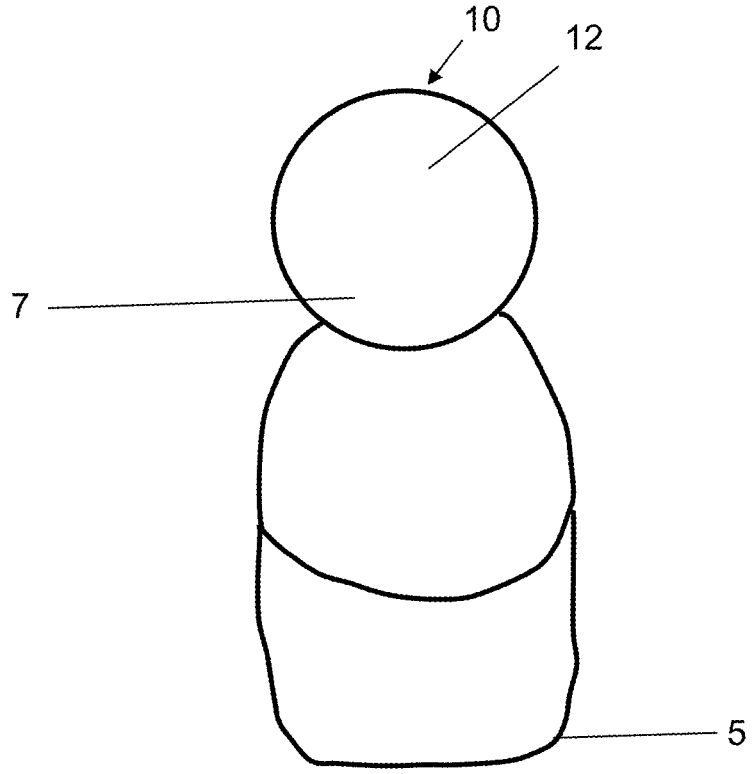
FIG. 1 is a perspective view from above of one embodiment of a hat mounted display device.

FIG. 1 illustrates one embodiment of a display device, which is generally indicated by numeral 10. Display device 10 is configured as a spherical member which is coupled to a hat 5, such as a hat with a visor, although other configurations are also in the scope of the invention.

Display device 10 comprises a bottom base section 7 coupled to hat 5 to provide a reactive force, and a top active section 12 that is rotatable with respect to base section 7 about a central axis of the spherical display device 10. Bottom base section 7 is imprinted with the logo, or a portion of the logo, of the team for which fans wearing display device 10 cheer. Alternatively, bottom base section 7 may be imprinted with indicia or with a picture associated with the team, such as a dominant player or a mascot. One or both of base section 7 and top section 12 may be made of a plastic material, such as expanded polystyrene, e.g. Styrofoam.

Top section 12 may also be provided with colors, imprinting, indicia or pictures, or a combination thereof, which are identical, similar or complementary to those of bottom section 7. Thus when the active elements of top section 12 are activated, a visible automated action that is directly associated with the team is performed. One visible action is the rotation of top section 12. Another visible action is the illumination of one or more peripheral regions of top section 12. These peripheral regions may flash in unison or non-simultaneously. Alternatively, each peripheral region may be illuminated with a different color. As an automated action is performed while hat 5 is being worn on a fan's head, the action is visible to many other fans sitting in the stadium. These other fans will also activate their active elements by means of the corresponding display devices to generate one or more visible actions that will send the crowd into a frenzy.

The use of a spherical display device according to any embodiment described herein increases the available display area relative to a planar display device, and allows the displayed image to be readily visible to a large number of sport fans sitting in the stadium at any given time without having to be physically held by a hand of the sport fan. Additionally, the spherical display device, when coupled to a worn hat, is positioned stably and symmetrically on the user's head, and will not impose excessive forces on the neck muscles of the user.

Figure 2:
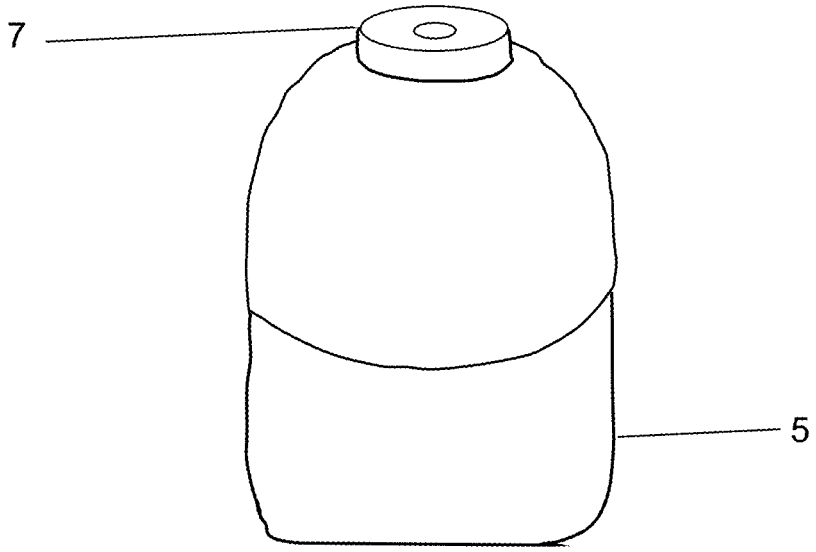
FIG. 2 is a perspective view from above of a hat to which is attached an interface member for interfacing with the display device of FIG. 1.
Figure 3:
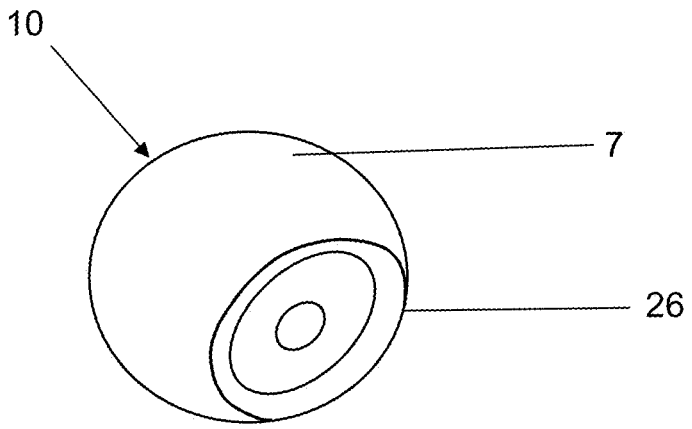
FIG. 3 is a perspective view from below of the display device of FIG. 1, showing a coupler adapted for being coupled with a hat mounted interface member.

As shown in FIGS. 2 and 3, base section 7 of display device 10 may be mounted on a rounded interface member 22, for example made of plastic material, which is releasably attached to hat 5 by means of releasable attachment elements, such as hook and loop fasteners. An annular coupler 26 affixed to, and protruding from, the underside of base section 7, which may be flattened, is adapted to be in engaged relation with the outer periphery of interface member 22, to prevent disengagement of base section 7 from interface member 22 during usage of display device 10.

Figure 4:
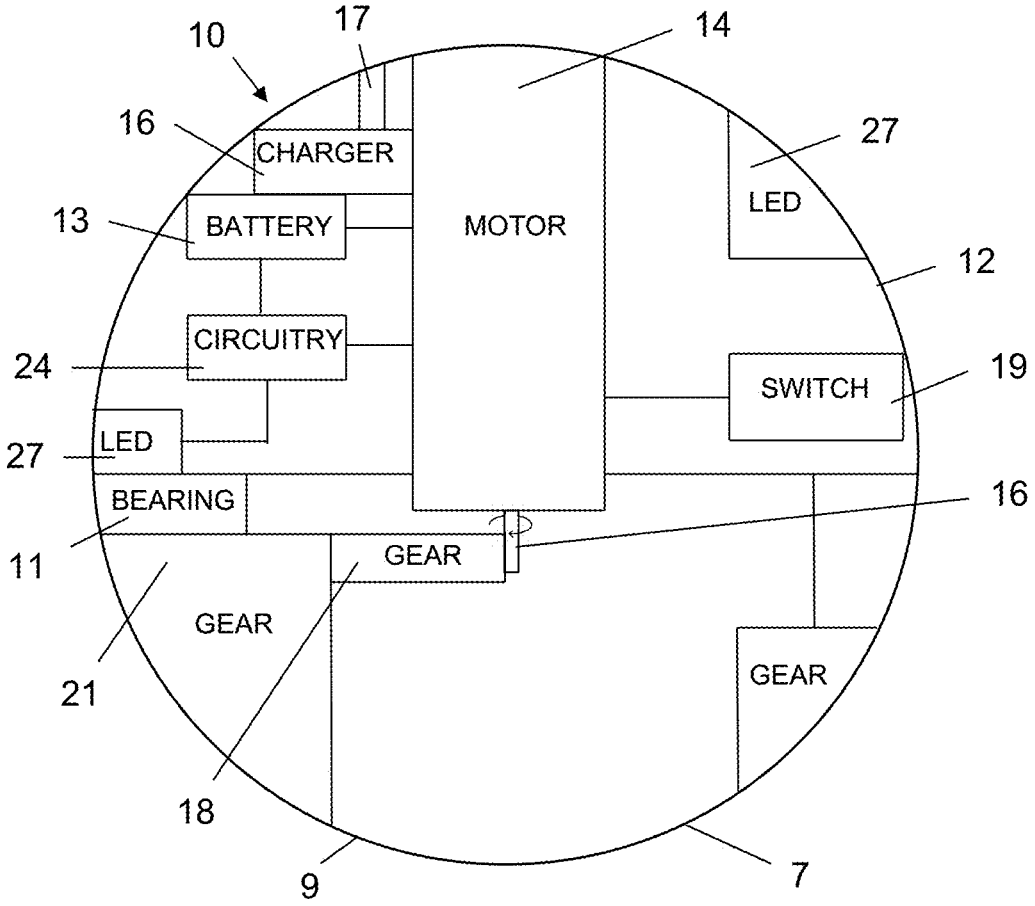
FIG. 4 is a block diagram of components of the display device of FIG. 1.

FIG. 4 illustrates a block diagram of display device 10, according to one embodiment. A motor 14 whose output shaft 16 is connected to a transmission element 18, such as a small-diameter gear, is mounted within top section 12. Gear 18 is interengaged with a large-diameter gear 21 attached to the inner face of the periphery 9 of base section 7. When motor 14 is operated, gear 18 applies a force onto gear 21 to cause top section 12 to rotate at a rate which is dependent on the motor speed and the gear ratio. A bearing element 11, such as an inexpensive plastic self-lubricating plain bearing, may be attached to the upper inner face region of the periphery 9 of base section 7 with which a portion of top section 12 is in movable contact, to reduce friction during rotation of top section 12.

Motor 14 is activated or deactivated by means of switch 19, which may also control one of two selected motor speeds, and circuitry 24 which may be provided on a printed circuit board. Circuitry 24, after activation of display device 10 by switch 19, also controls operation of one or more illumination elements 27, such as switchable or flashable LED light elements, to control illumination of a visible action that stimulates cheering for a particular team. One or more replaceable batteries 13, e.g. rechargeable Lithium batteries, for powering motor 14 and circuitry 24 according to the selected motor speed is housed within top section 12. A charging unit 16 for charging each battery 13 may be accessed by socket 17.

Figure 5:
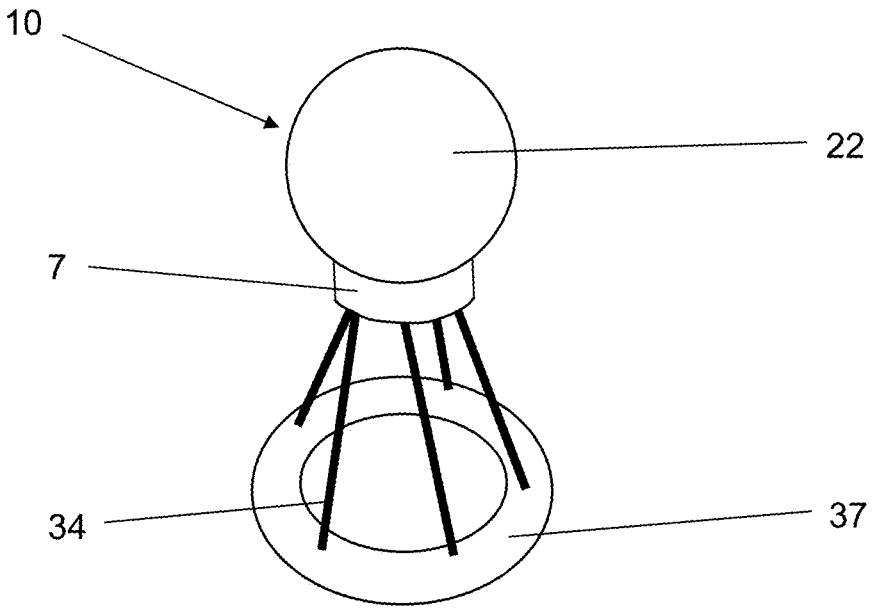
FIG. 5 is a perspective view from the side of another embodiment of a hat mounted display device.

FIG. 5 illustrates a display device 30, according to another embodiment. Height-extended display device 30 comprises the previously described display device 10 and a plurality of rods 34 that support base section 7 from below. The rods 34 extend obliquely from the bottom of interface member 22 to the periphery of a ring 37 having a diameter significantly greater than that of interface member 22, to provide good support and to increase visibility by raising display device 10 higher above the hat to which ring 37 is attached by means of releasable attachment elements. Rods 34 may be connected to interface member 22, or, alternatively, may pass through interface member 22 into base section 7, to which the rods are connected.

Each of rods 34 may be provided with additional one or more illumination elements, which may be in electrical communication with circuitry 24 (FIG. 4) by means of a flexible cable extending through the interior of base section 7 to a contact of the additional illumination elements that is accessible to the interior of base section 7. With the use of a flexible cable, top section 12 is able to rotate alternately in clockwise and counterclockwise directions without undue tangling of the flexible cable.

Figure 6:
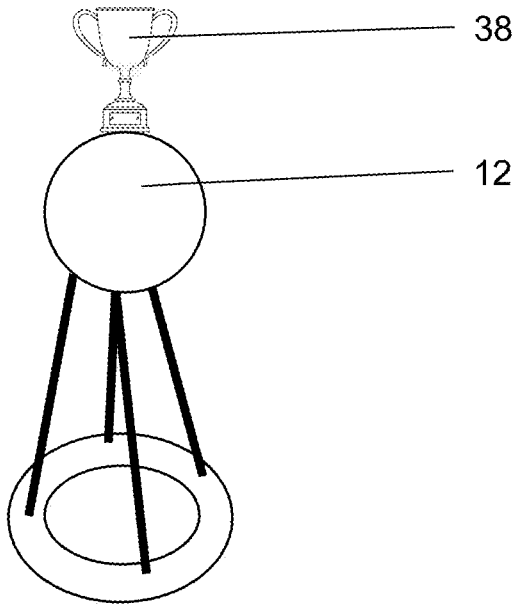
FIG. 6 is a perspective view from the side of another embodiment of a hat mounted display device, which includes a championship cup.

FIG. 6 is a perspective view from the side of another embodiment of a hat mounted display device, which includes a championship cup 38, mounted on top of the rotatable active section 12.

Figure 7:
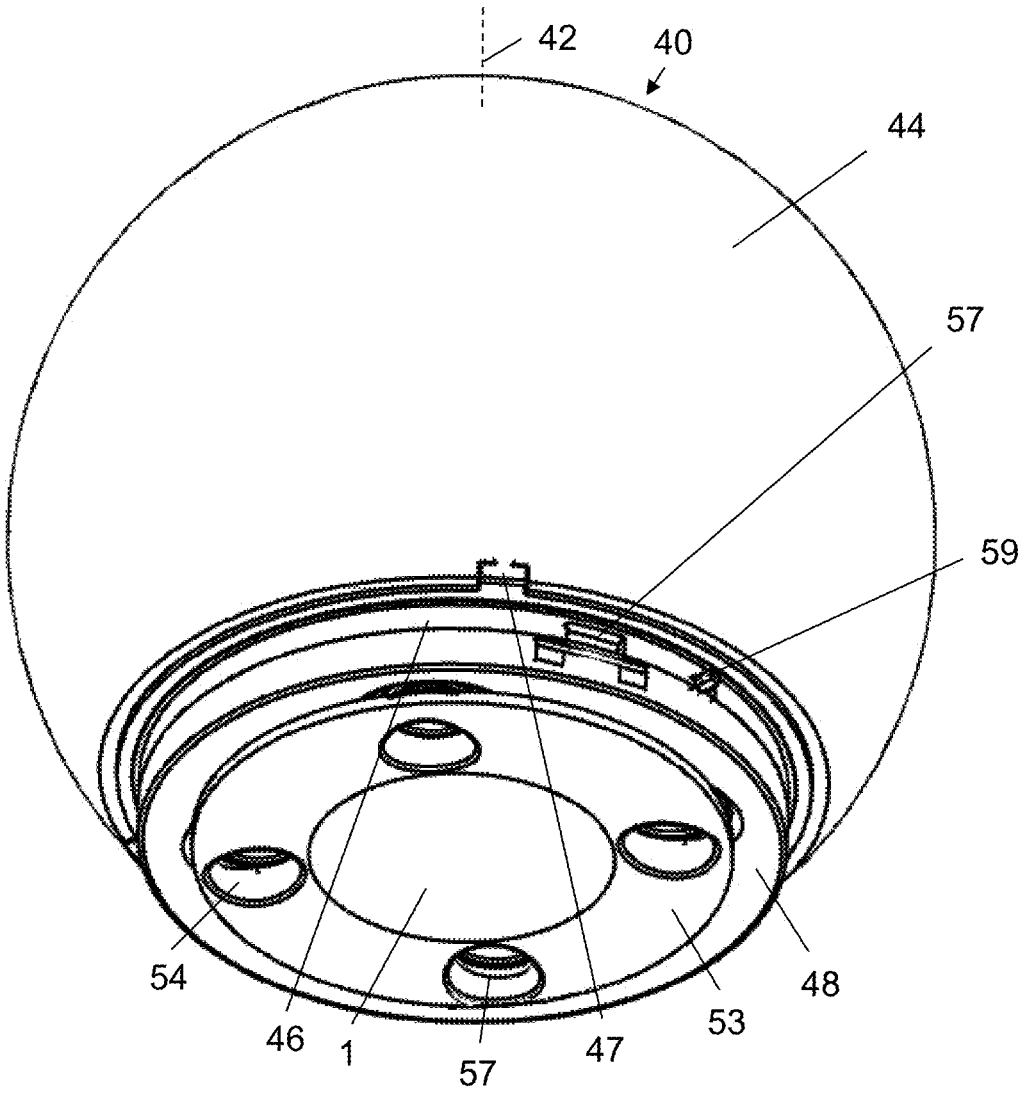
FIG. 7 is a perspective view from the bottom of another embodiment of a hat mounted display device, showing a plate magnetically coupled to a base after the hat which was previously positioned therebetween has been removed.

FIG. 7 is a perspective view from the bottom of another embodiment of a hat mounted display device, which is generally indicated by numeral 40. Display device 40 comprises a unitary rotatable spherical body 44 which is able to display illuminated insignia or images related to a specific sport team, and a motor for rotatably driving spherical body 44 about its central axis 42. The insignia or images may be permanently provided on the outer surface of spherical body 44, or alternatively may be temporarily applied thereto. Spherical body 44 is releasably securable to a protective tubular covering 47 of a rotor case 46 of the motor, so that spherical body 44, rotor case 46 and protective covering 47 will rotate in unison relative to a stationary base 48 which is connected to the stator of the motor. Rotor case 46 will begin rotating upon activation of a battery for powering the motor by mechanical switch 59. Socket 57 formed on rotor case 46, which may be positioned next to switch 59, is used for charging the battery, such as by a USB charging unit that is insertable therein. Alternatively, a remotely controlled switch, which may be parallel to mechanical switch 59, may be used to activate display device 40.

Base 48 is able to be magnetically coupled to a hat by means of a plate 53, e.g. circular, configured with a plurality of through-holes 54, e.g. four through-holes, within each of which is received a corresponding permanent magnet, not shown. These plate-mounted magnets are adapted to be magnetically coupled to corresponding permanent magnets 57 seated within base 48. By virtue of the significantly large magnetic field exerted by the large number of magnets, plate 53 may be urged to rotate until the plate-mounted magnets become aligned with corresponding base-mounted magnets. Accordingly, display device 40 may be easily mounted by centering base 48 on top of the hat and positioning plate 53 below the hat so as to be magnetically coupled with the base. If so desired, a cushioning element may be applied to the bottom of plate 53 in order to be comfortably mounted on the user's head.

Figure 8:
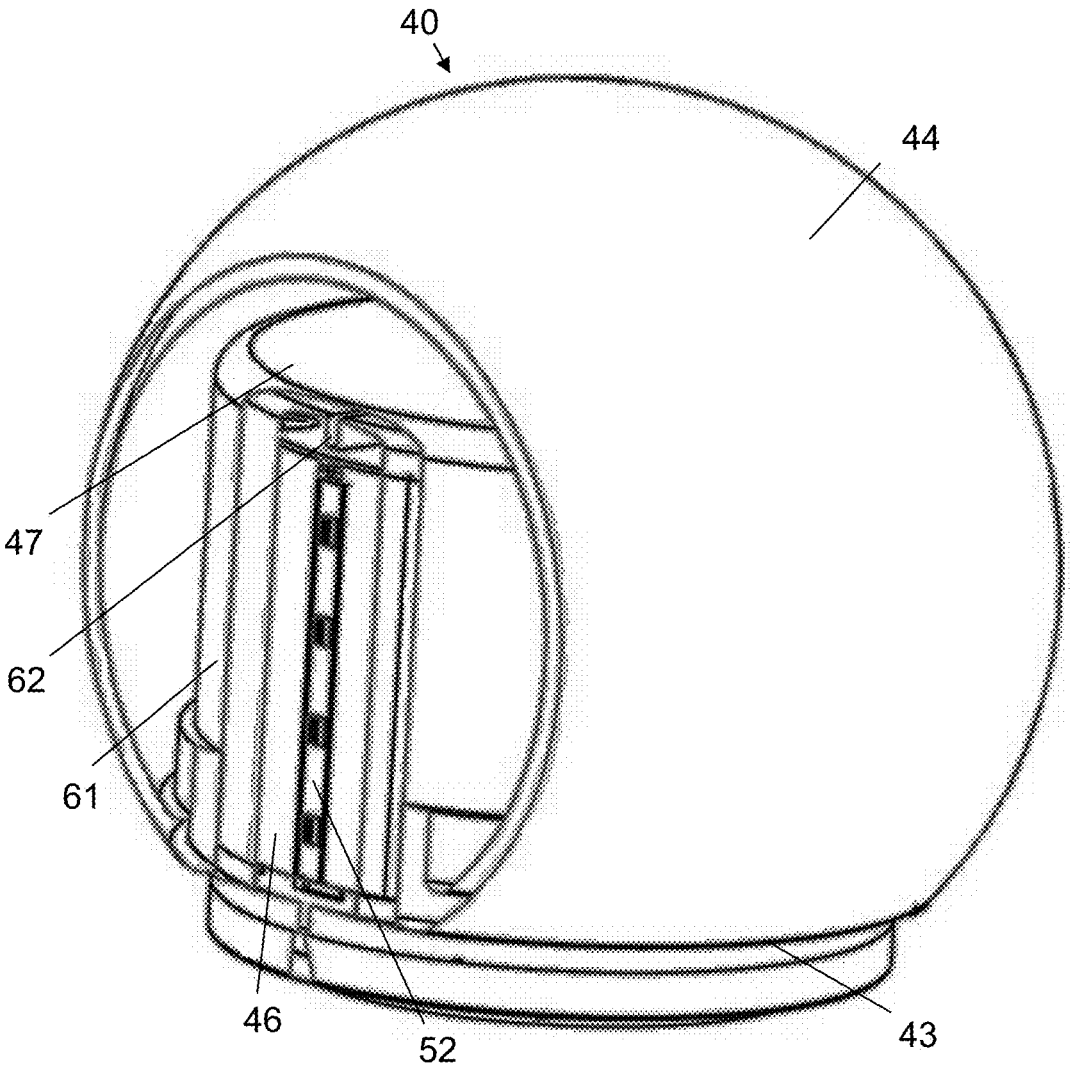
FIG. 8 is a fragmentary perspective view through the spherical body and rotor-associated protective covering of the display device of FIG. 7, showing portions of an interface element radially protruding from the protective covering.
Figure 9:
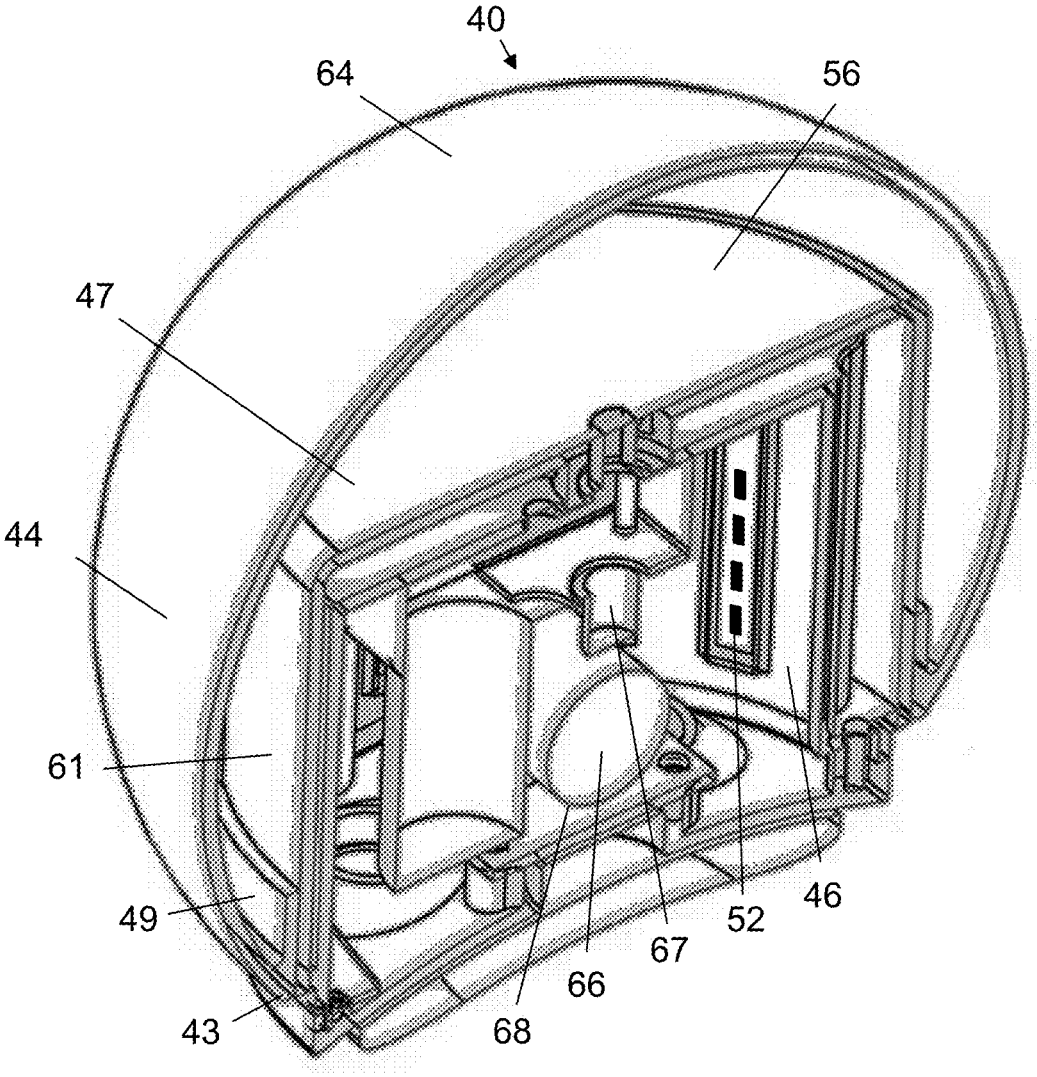
FIG. 9 is a fragmentary perspective view through the spherical body and rotor case of the display device of FIG. 7, showing a portion of a drive shaft connected to the protective covering.
Figure 10:
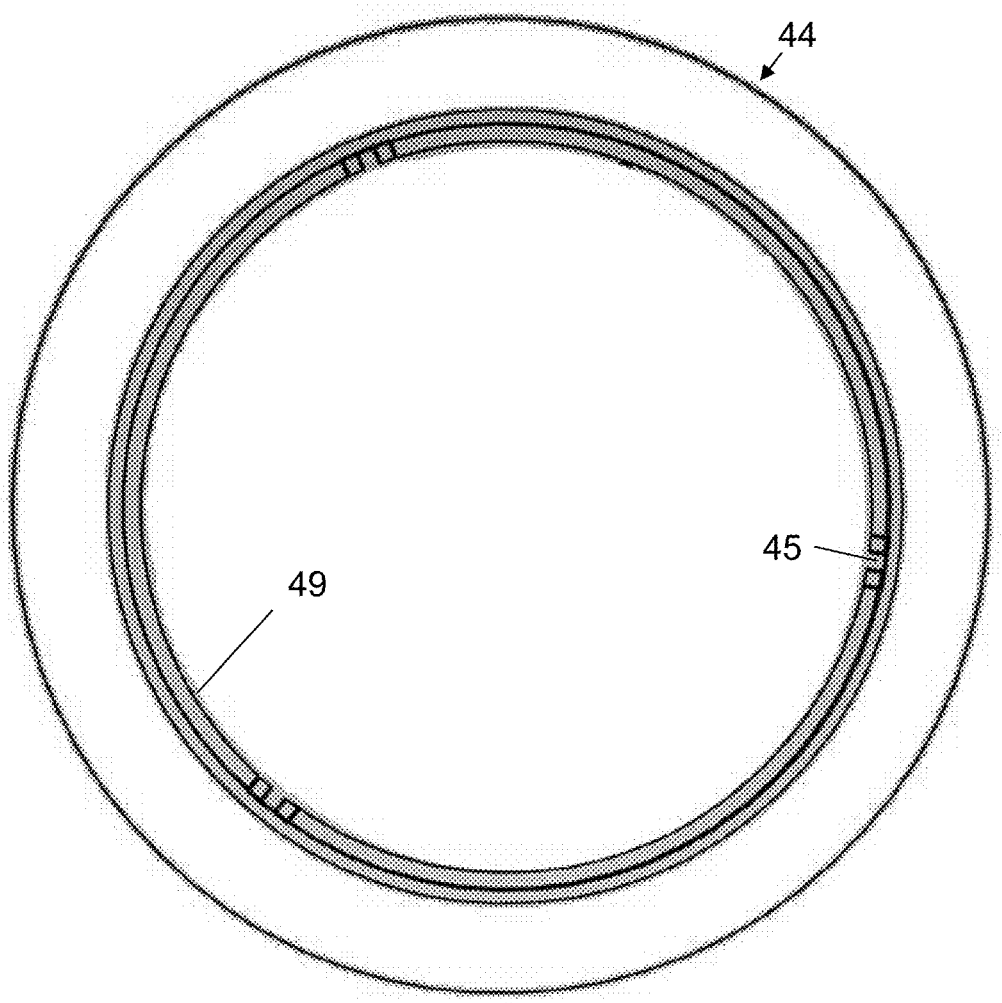
FIG. 10 is a bottom view of a spherical body used in conjunction with the display device of FIG. 7, showing grooves that are able to interface with corresponding protrusions, when decoupled from the protective covering.

FIGS. 8-10 show interface elements for releasably securing spherical body 44 to protective covering 47 of rotor case 46, which is preferably transparent, so that the LED lights 52 will be visible. Protective covering 47 is configured with a plurality, e.g. four, of circumferentially spaced, integral radial protrusions 62 that extend vertically along the rounded sidewall 61 of the protective covering. An inner peripheral lip 49 of spherical body 44, shown in FIG. 9 to have a height approximately equal to one-quarter the height of sidewall 61 of protective covering 47, is coincident with the lower edge 43 of spherical body 44, and is formed with a plurality of circumferentially spaced grooves 45 shown in FIG. 10. By aligning one of the grooves 45 above a corresponding protrusion 62 and lowering spherical body 44, all of the protrusions are received in a corresponding groove, to releasably secure spherical body 44 to rotor case 46 so that they can rotate in unison by means of rotor-connected shaft 67. Shaft 67 in turn is kinematically connected to a rotatable member associated with the rotor. When spherical body 44 and rotor case 46 are connected together, the planar top 56 of protective covering 47 may be significantly spaced from upper portion 64 of spherical body 44. Shaft 67 may be connected directly to a seat formed in an inner face of planar top 56 of protective covering 47, or may be connected by means of a dedicated key fitted in a recess formed in the inner face of planar top 56.

A plurality of circumferentially spaced LED strips 52, or by any other arrangement of LED lights, powered by the battery and mounted on the peripheral wall of rotor case 46 become illuminated simultaneously with the rotation of rotor case 46, when the battery is activated. A printed circuit board 68 causes the LED strips 52 to become illuminated. The image provided on the rotating spherical body 44 will be clearly visible to a large number of fans, particularly by virtue of the illuminated LED strips 52. The LED lights preferably have a sufficiently high brightness to be seen by distant spectators or sport participants within the stadium, for example having a light output corresponding to a power consumption ranging from 5-10 W. LED strips 52 may continuously illuminated when activated, or alternatively may be periodically or intermittently illuminated to provide special illumination effects that promote additional fan interaction in response to operation of display device 40 and to conserve battery consumption. The displayed image may complement the curved contour of spherical body 44, to provide additional special effects.

If the user is a spectator of another sporting event involving a different team, a first spherical body 44 is decoupled from protective covering 47 and replaced with a second spherical body provided with different images.

In another embodiment, the spherical body, which may be releasably securable to protective covering 47, is configured as a spherical LCD screen for displaying selected electronically generated images. A local control unit interfaces with the screen to facilitate a change in the displayed images, such as dynamic images whereby an image is sequentially displayed in changing and contiguous regions of the spherical screen. The visibility of the spherical LCD screen is enhanced by the set of LED lights which are mounted on the peripheral wall of rotor case 46.

Figure 11:
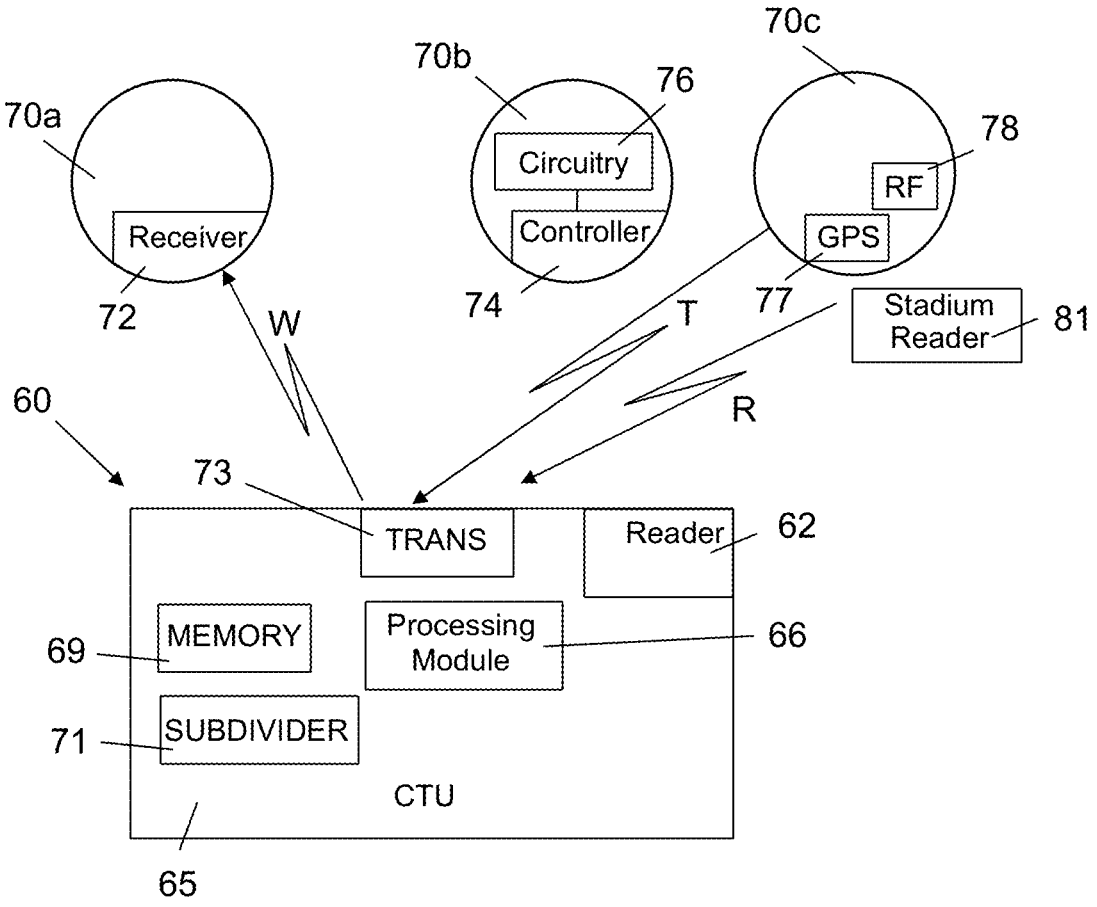
FIG. 11 is a schematic illustration of a system for displaying spectator-wide content.

FIG. 11 schematically illustrates a system for generating a spectator display involving a large number of spectators. The generated display may be a constant-content display or a dynamic-content display.

System 60 comprises a plurality of distributed hat-mounted display devices 70, for example devices 70*a-c*. The body of each display device 70 may be similar to that of display device 10 of FIG. 1, similar to that of display device 40 of FIG. 7, configured as a spherical LCD screen, or configured in another suitable fashion such as comprising illumination elements but not a motor, or configured without a spherical body, but may additionally enclose a receiver 72 adapted to receive a wireless signal and a controller 74 adapted to operate device-mounted circuitry 76 in accordance with data associated with the received signal, and optionally a GPS chip 77 or other location indicating element 78 for indicating an instantaneous location of the display device.

In addition, system 60 comprises a central transmitting unit (CTU) 65 for transmitting a wireless signal W that includes device-specific data related to content that is to be displayed by means of a transceiver 73 to a large number of devices 70 simultaneously or successively. The desired spectator-wide content to be displayed may be stored offline as an image in a memory device 69, such as a database, and may be subdivided prior to, or during, a sporting event by a subdividing module 71 to a number of portions corresponding to the number of fans of a certain team involved in the sporting event that are known to be located in the stadium. A processing module 66 commands transceiver 73 to transmit the device-specific data to each registered device, so that the device receiving the transmitted device-specific data will display a portion of the spectator-wide content.

The device-specific data may be indicative of a time when to activate or deactivate the motor to cause rotation of the spherical body or to activate or deactivate the illumination elements. Alternatively or in addition, the device-specific data may be indicative of a constant or time-dependent light intensity of the light to be emitted by each illumination element or by each region of the spherical body, or of a constant or time-dependent color or indicia to be displayed by each region of a spherical LCD screen.

A reader terminal 62 for storing the location or address of each display device 70 in memory device 69 receives spectator-specific information as well as a device type upon consent of the spectator when he or she enters the stadium in order to register the device for use in displaying the spectator-wide content. Reader terminal 62 may comprise a magnetic reader to read seating information associated with an admission ticket, or may be Internet or WIFi enabled to read the wireless address of each display device.

The spectator-specific information may be related to the location of an assigned seat, or of a real time spectator location when a general admission scheme is in use within the stadium such that seat selection is made on a first-come, first-served basis. At times, the spectator-specific information is related to both the location of an assigned seat and of a real time spectator location. The real time spectator location may be determined by a GPS chip 77 mounted within the display device and by processing module 66 provided within CTU 65, within which is installed a GPS tracking application for receiving data output by the GPS chip that is included in a signal T, so that it will be suitably processed. Alternatively, the real time spectator location is determined by an RF tag 78 mounted within the display device and by one of a plurality of stadium-installed RF readers 81 which are configured to transmit a signal R that includes location data acquired from a display device in range to processing module 66 via transceiver 73.

Upon receiving the real time spectator location, processing module 66 commands transceiver 73 to transmit the device-specific data via a signal. W to the real-time location of each registered device so that the spectator-wide content will be reliably displayed.

Figure 12:
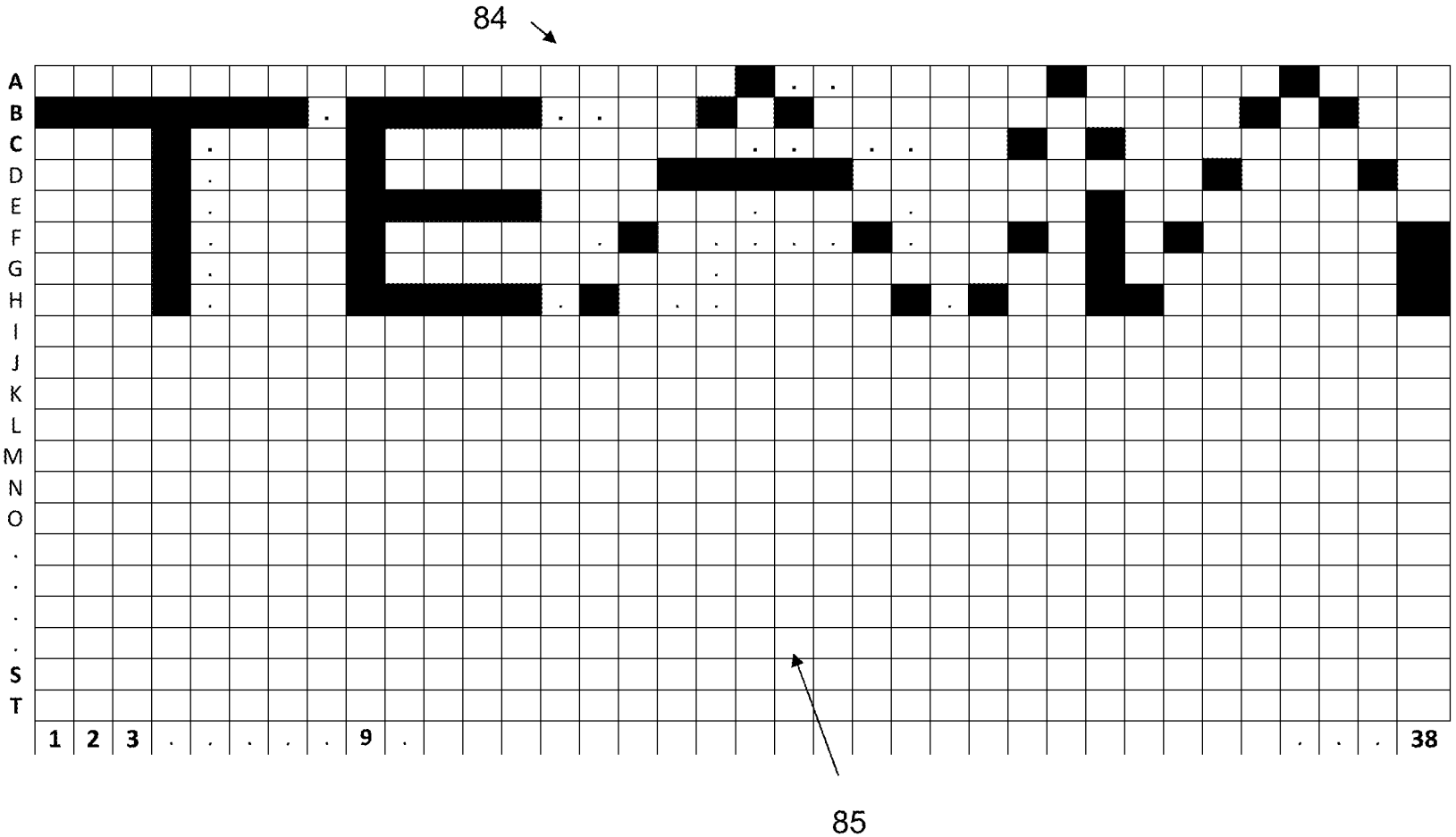
FIG. 12 is a schematic illustration of the display of exemplary spectator-wide content, showing the selective operation of distributed display devices.

As shown in FIG. 12, the displayed spectator-wide content 84 may be indicia, for example the illustrated "TEAM" indicia generated by the simultaneous operation and illumination of display devices located at seats A19, 28 and 34, B1-7, 9-13, 18, 20, 33 and 35, C4, 9, 18, 27 and 29, D4, 9, 17-21, 32 and 37, E 4, 9-13 and 29, F4, 9, 16, 22, 26, 29, 31 and 38, G4, 9, 29 and 38, and H4, 9-13, 15, 23, 25, 29-30 and 38 of stadium 85, while neighboring display devices are not operated. The contrast between the active illuminated display devices and the neighboring inactive display devices displays the large-sized indicia content that is visible for a large distance, such as visible to the participants of the sporting event or even to spectators at the other side of the stadium. All of the display devices are generally illuminated to the same color; however, it will be appreciated that a first group may be illuminated to a first color and a second group may be illuminated to a second color, for example when the corresponding spectators were presented with spherical bodies of the second color upon registration.

In other embodiments, the displayed spectator-wide content is dynamic, such that the displayed indicia content is periodically changed upon transmission of different device-specific data to the known or real time spectator location associated with each registered device.

In other embodiments, such as when spherical LCD screens are employed as the spherical body, the displayed spectator-wide content may be an insignia of the team, an image of a well-known player of the team, or even an animated image, such as one showing a player kicking a ball. The transmitted device-specific data may include a file, such as a TIF file, which is representative of the portion of the spectator-wide content to be displayed by the given display device.

Figure 13:
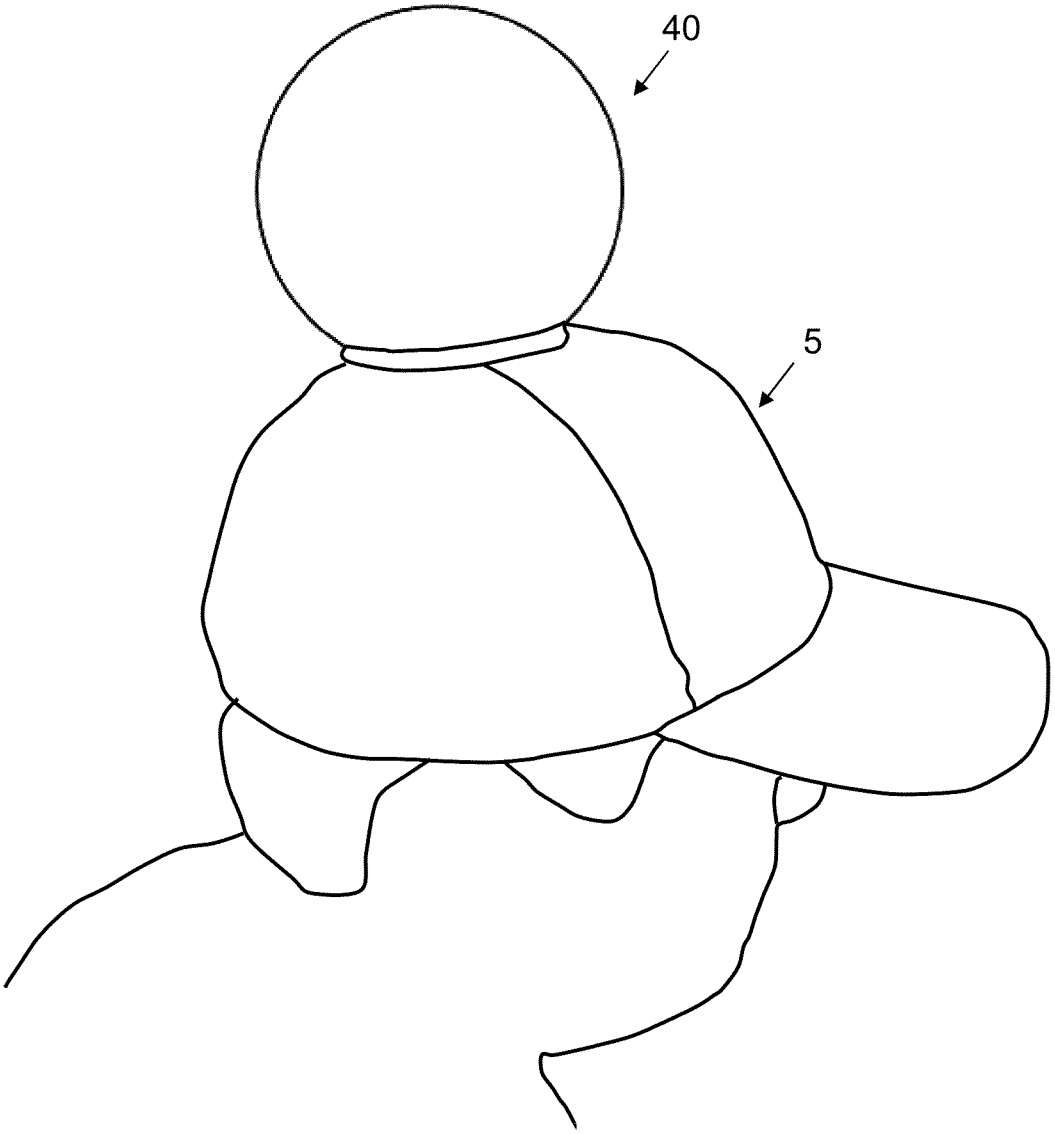
FIG. 13 shows a display device for sport fans which is coupled to a hat worn by a user.

FIG. 13 shows a display device 40 for sport fans which is coupled to a hat 5 worn by a user.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A display device for sport fans which is adapted to be coupled to a hat worn by a user, said display device comprising:

a) a spherical body which is displayable with visible images related to a specific sport team;

b) one or more interface elements associated with said spherical body which are releasably securable to a display device mount; and c) at least first and second active elements, which, when activated, cause at least a portion of said spherical body to be controllably rotated about its central axis through interaction of said one or more releasably securable elements and simultaneously illuminated.

2. The display device according to claim 1, wherein the first active element is a motor and the second active element is at least one illumination element, the motor and the at least one illumination element being powered by a battery and being activated by a switch, wherein the battery, the motor and the at least one illumination element are mounted interiorly to the spherical body.

3. The display device according to claim 2, further comprising a protective tubular covering of a rotor case of the motor which constitutes the display device mount, and a stationary stator-connected base relative to which the spherical body, rotor case and protective covering rotate in unison.

4. The display device according to claim 3, wherein the base is magnetically coupleable to the hat by means of a magnetic plate placed in contact with an inner region of the hat to facilitate symmetric positioning of the spherical body with respect to the user's head when the hat is worn.

5. The display device according to claim 2, wherein the spherical body comprises a bottom base section coupled to the hat, and an upper active section that comprises the at least first and second active elements and that is rotatable with respect to said base section about the central axis of the spherical body.

6. The display device according to claim 5, wherein the motor is mounted to the upper section and the battery and the switch are housed within the upper section.

7. The display device according to claim 5, further comprising a plurality of obliquely extending rods that support the base section from below, for increasing a height of the spherical body relative to the hat and to thereby increase visibility of the display device.

8. The display device according to claim 1, further comprising a receiver adapted to receive a wireless signal and a controller adapted to operate device-mounted circuitry in accordance with data associated with the received signal.

9. The display device according to claim 8, further comprising a location indicating element for indicating an instantaneous location of the display device to facilitate directing transmission of the wireless signal.

10. The display device according to claim 1, wherein a first spherical body provided with a first set of visible images is able to be replaced with a second spherical body provided with a second set of visible images.

11. The display device according to claim 1, wherein the visible images related to a specific sport team are selected from the group consisting of a logo of the sport team, an insignia of the sport team, a portion of the logo or of the insignia, indicia associated with the team, a picture associated with the team, one or more colors associated with the team, imprinting associated with the team, an image associated with a player or with a mascot of the team, and a combination thereof.

12. A system for displaying spectator-wide content at a stadium, comprising a plurality of distributed hat-mounted display devices, each of said display devices configured with at least one illumination element, a receiver adapted to receive a wireless signal, a controller adapted to operate device-mounted circuitry for selectively activating said at least one illumination element in accordance with data associated with the received signal, and a battery for powering said at least one illumination element, receiver and controller; and a central transmitting unit for transmitting the wireless signal, to each of said display devices that have been registered, which includes device-specific data related to a corresponding portion of spectator-wide content that is to be displayed.

* * * * *